US011143155B2

(12) United States Patent
Kwon

(10) Patent No.: US 11,143,155 B2
(45) Date of Patent: Oct. 12, 2021

(54) AUTOMOBILE AND METHOD OF RESTARTING ENGINE OF AUTOMOBILE

(71) Applicants: Hyundai Motor Company, Seoul (KR); KIA Motors Corporation, Seoul (KR)

(72) Inventor: Jun-Ho Kwon, Busan (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 64 days.

(21) Appl. No.: 16/671,400

(22) Filed: Nov. 1, 2019

(65) Prior Publication Data

US 2020/0182215 A1 Jun. 11, 2020

(30) Foreign Application Priority Data

Dec. 10, 2018 (KR) ..... 10-2018-0158356

(51) Int. Cl.

| | |
|---|---|
| ***F02M 25/08*** | (2006.01) |
| ***F02N 11/08*** | (2006.01) |
| ***F02M 35/10*** | (2006.01) |
| ***F01M 13/02*** | (2006.01) |
| ***F01N 9/00*** | (2006.01) |
| ***F02D 41/00*** | (2006.01) |

(52) U.S. Cl.

CPC ..... *F02N 11/0818* (2013.01); *F01M 13/023* (2013.01); *F01N 9/00* (2013.01); *F02D 41/0002* (2013.01); *F02M 25/08* (2013.01); *F02M 35/10222* (2013.01); *F01M 2013/027* (2013.01); *F02D 2041/002* (2013.01); *F02D 2041/0017* (2013.01)

(58) Field of Classification Search

CPC ..... F02M 25/08; F02M 25/0818; F02M 25/0827; F02M 25/0836

See application file for complete search history.

(56) References Cited

U.S. PATENT DOCUMENTS

2011/0247594 A1* 10/2011 Pursifull ..... F02M 25/089 123/520
2015/0159597 A1* 6/2015 Woods ..... F02M 25/089 123/495
2016/0123280 A1* 5/2016 Making ..... F02M 25/089 123/519
2017/0226939 A1* 8/2017 Akita ..... B01D 53/0415
2017/0260931 A1* 9/2017 Guidi ..... F02M 26/43

(Continued)

FOREIGN PATENT DOCUMENTS

KR 10-2018-0070114 A 6/2018

*Primary Examiner* — Thomas N Moulis
(74) *Attorney, Agent, or Firm* — Brinks Gilson & Lione

(57) ABSTRACT

An automobile power system in a vehicle may include an intake pipe supplying external air to an engine supplying power to driving wheels, a canister connected with a fuel tank to absorb evaporation gas produced in the fuel tank, an active purging system compressing and supplying the evaporation gas absorbed in the canister to the intake pipe, a diverging line extending from the active purging system to the engine, a diverging valve mounted on the diverging line, and a starting motor rotating a crankshaft when the engine is started. In addition, the evaporation gas absorbed in the canister is supplied to the engine through the diverging line before the engine is restarted, and then the starting motor is operated.

17 Claims, 2 Drawing Sheets

(56) References Cited

U.S. PATENT DOCUMENTS

Figure 1:
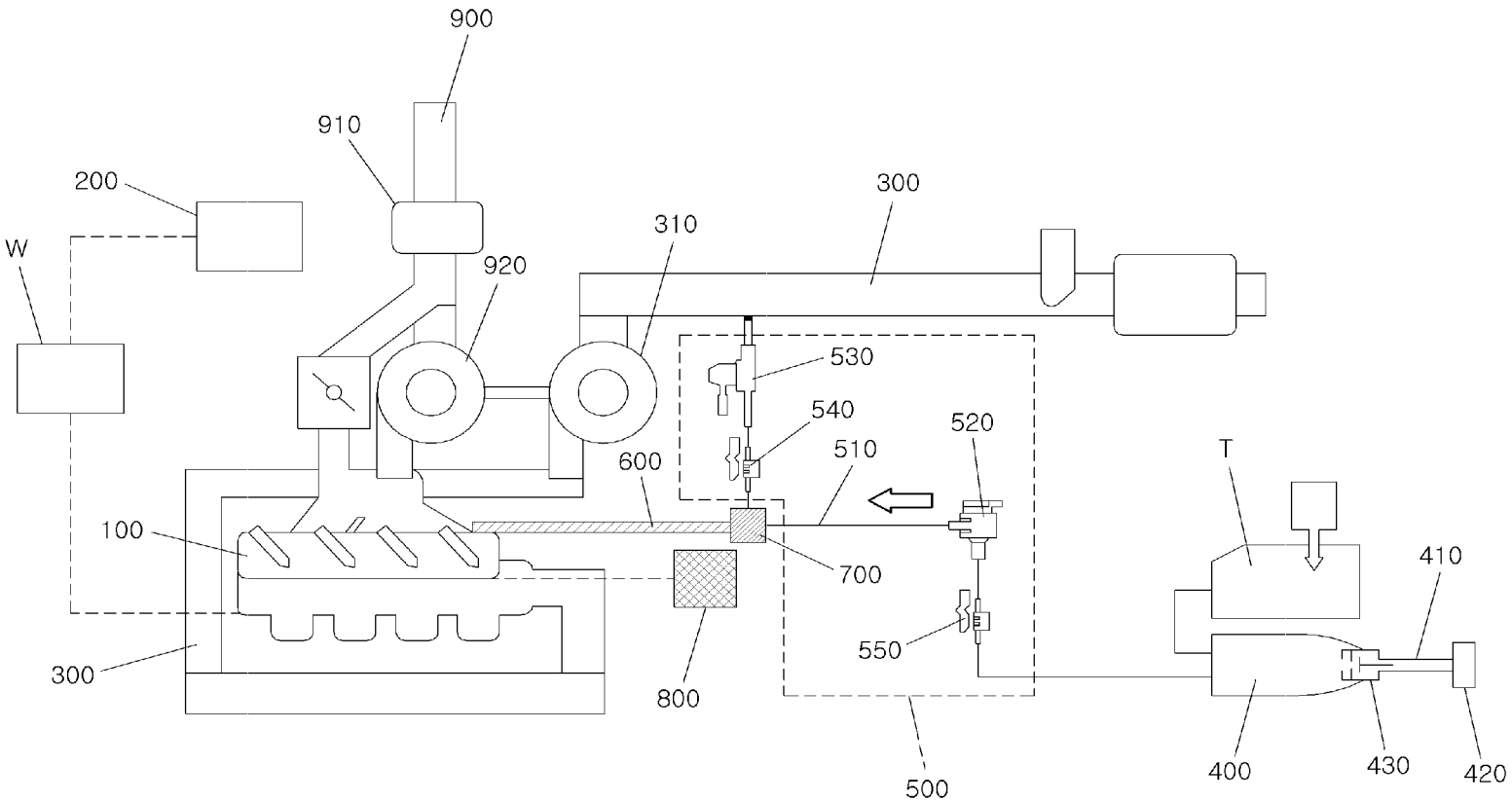

| | | | | |
|---|---|---|---|---|
| 2018/0372030 | A1* | 12/2018 | Achleitner | F02M 25/089 |
| 2019/0186393 | A1* | 6/2019 | Oh | F02M 35/10157 |
| 2019/0234294 | A1* | 8/2019 | Sager | F02D 41/0032 |
| 2019/0360434 | A1* | 11/2019 | Dudar | F02D 41/0032 |
| 2020/0378323 | A1* | 12/2020 | Oh | F02D 13/0207 |

* cited by examiner

AUTOMOBILE AND METHOD OF RESTARTING ENGINE OF AUTOMOBILE

CROSS-REFERENCE TO RELATED APPLICATION

This application claims priority to and the benefit of Korean Patent Application No. 10-2018-0158356, filed on Dec. 10, 2018, which is incorporated herein by reference in its entirety.

FIELD

The present disclosure relates to an automobile power system and a method of restarting an engine in an automobile power system for a vehicle.

BACKGROUND

The statements in this section merely provide background information related to the present disclosure and may not constitute prior art.

Hybrid vehicles are equipped with an engine and a motor as driving sources. Hybrid vehicles can be driven in an electric vehicle (EV) mode using only a motor in a low-load period and can operate both an engine and a motor in a high-load period, thereby providing maximum energy efficiency. For this reason, the engine is frequently stopped and then restarted during driving.

Meanwhile, the space for an engine is relatively small in hybrid vehicles, as compared to vehicles with an internal combustion engine. Accordingly, small engines are provided in the hybrid vehicles. Hybrid vehicles are equipped with a charger such as a turbocharger to provide the same performance as large engines from small engines.

A turbocharger supplies a large amount of air into an engine, so the concentration of nitrogen and oxygen supplied to a combustion chamber is relatively high. Accordingly, when the engine of a hybrid vehicle equipped with a turbocharger is started, we have discovered that there is a high possibility that nitrogen oxides are produced by reaction of high-concentration nitrogen and oxygen.

A catalyst that reduces nitrogen oxides is provided in an exhaust pipe, but exhaust gas is not sent to the catalyst when an engine is stopped, so the catalyst has high oxygen saturation that is disadvantageous to deoxidization of nitrogen oxides.

The above information disclosed in this Background section is only for enhancement of understanding of the background of the present disclosure, and therefore it may contain information that does not form the prior art that is already known to a person of ordinary skill in the art.

SUMMARY

The present disclosure provides an automobile power system that can reduce oxygen saturation of a catalyst to be favorable to deoxidization of nitrogen oxides when an engine is restarted in a vehicle, and a method of the automobile power system for restarting an engine of the vehicle.

According to a form of the present disclosure, the automobile power system in a vehicle includes an intake pipe supplying external air to an engine supplying power to driving wheels, a canister connected with a fuel tank to absorb evaporation gas produced in the fuel tank, an active purging system compressing and supplying the evaporation gas absorbed in the canister to the intake pipe, a diverging line extending from the active purging system to the engine, a diverging valve mounted on the diverging line and a starting motor rotating a crankshaft when the engine is started, in which the evaporation gas absorbed in the canister is supplied to the engine through the diverging line before the engine is restarted, and then the starting motor is operated.

According to a further form of the present disclosure, the active purging system may include a purge line connecting the canister and the intake pipe, a purge pump mounted on the purge line, a purge valve mounted on the purge line between the purge pump and the intake pipe, a first pressure sensor mounted on the purge line between the purge pump and the purge valve and a second pressure sensor mounted on the purge line between the canister and the purge pump and the diverging line may diverge from the purge line between the pressure sensor and the purge pump, or from the purge line between the second pressure sensor and the purge pump.

The automobile power system may further include an exhaust pipe through which combustion gas from the engine is discharged. In addition, the exhaust pipe may include a catalyst mounted on the exhaust pipe; a turbocharger mounted on the exhaust pipe and a compressor mounted on the intake pipe to be synchronized in rotation with the turbocharger. The canister may include a vent line extending toward the atmosphere from the canister, a filter mounted at an end of the vent line, and a vent valve mounted on the vent line between the canister and the filter.

According to a further form of the present disclosure, the catalyst may include precious metal.

The diverging valve may be fully (100%) opened when the engine is stopped, and may be fully closed when the starting motor is operated.

In addition, the purge valve provided in the active purging system to connect/disconnect the canister and the intake pipe may be fully closed when the engine is stopped.

According to a further form of the present disclosure, the automobile power system may further include a motor supplying power to the driving wheels independently from the engine and being driven even with the engine stopped.

The diverging valve may be fully (100%) opened when the engine is stopped, and may be fully closed when the starting motor is operated.

In addition, the purge valve provided in the active purging system to connect/disconnect the canister and the intake pipe may be fully closed when the engine is stopped.

A method of restarting an engine of an automobile power system for a vehicle according to a form of the present disclosure includes steps of driving the vehicle with an engine stopped, determining whether the temperature of the catalyst mounted on an exhaust pipe is a catalyst activation temperature or more, supplying evaporation gas to the engine by operating a purge pump of an active purging system, determining whether a starting motor is operated, and closing a diverging valve mounted on a diverging line connecting the active purging system and the engine and stopping operation of the purge pump.

According to a further form of the present disclosure, the method may further include steps of decreasing oxygen saturation of the catalyst by making evaporation gas supplied to the engine by operating of the starting motor in the catalyst and then oxidizing the evaporation gas, and deoxidizing nitrogen oxides that have been produced by starting of the engine and have flowed in the catalyst.

When the temperature of the catalyst is not the catalyst activation temperature or more, the diverging valve may be closed and the purge pump may be stopped.

In the supplying of evaporation gas to the engine, concentration of the evaporation gas in the active purging system may be calculated, RPM and operation time of the purge pump may be calculated on the basis of the calculated concentration of the evaporation gas, and then the purge pump may be operated on the basis of the calculated RPM and operation time.

According to a further form of the present disclosure, when the starting motor is not operated, determining whether the evaporation gas supplied to the engine is at an appropriate level may be performed, when the evaporation gas supplied to the engine is less than the appropriate level, the supplying of evaporation gas to the engine by operating the purge pump may be performed again, and when the evaporation gas supplied to the engine is at the appropriate level or higher, the diverging valve is closed and the purge pump may be stopped.

A method of restarting an engine of an automobile according to another form of the present disclosure includes steps of driving a vehicle using a motor, determining whether the temperature of the catalyst mounted on an exhaust pipe is a catalyst activation temperature or more, supplying evaporation gas to the engine by operating a purge pump of an active purging system, determining whether a starting motor is operated, and closing a diverging valve mounted on a diverging line connecting the active purging system and the engine and stopping operation of the purge pump.

In the supplying of evaporation gas to the engine, concentration of the evaporation gas in the active purging system may be calculated, RPM and operation time of the purge pump may be calculated on the basis of the calculated concentration of the evaporation gas, and then the purge pump may be operated on the basis of the calculated RPM and operation time.

According to a further form of the present disclosure, when the starting motor is not operated, determining whether the evaporation gas supplied to the engine is at an appropriate level may be performed, when the evaporation gas supplied to the engine is less than the appropriate level, the supplying of evaporation gas to the engine by operating the purge pump may be performed again, and when the evaporation gas supplied to the engine is at the appropriate level or higher, the diverging valve is closed and the purge pump may be stopped.

According to the automobile power system and the method of restarting an engine of the automobile power system of the present disclosure, the evaporation gas that is injected into the engine or exists in the diverging line is moved to the exhaust pipe by piston pumping when the starting motor is operated. The evaporation gas is oxidized by the catalyst mounted on the exhaust pipe and having a temperature over a catalyst activation temperature, whereby hydrocarbon contained in the evaporation gas is reduced. As the evaporation gas is oxidized, the oxygen concentration of the catalyst is reduced. The atmosphere of the catalyst becomes dense, so it becomes favorable to deoxidization of nitrogen oxides.

The purge ration of the evaporation gas collected in the canister is improved.

Accordingly, it is possible to control oxygen saturation of the catalyst even with the engine stopped.

It is also possible to increase the degree of removing nitrogen oxides from the catalyst when discharging the nitrogen oxides at the early stage of restarting the engine.

Furthermore, it is possible to reduce a leakage amount of evaporation gas, so it is possible to reduce exhaust of carbon monoxide and hydrocarbon.

The degree of removing nitrogen oxides is increased and exhaust gas is consequently reduced, so the precious metal amount of the catalyst can be reduced.

Further areas of applicability will become apparent from the description provided herein. It should be understood that the description and specific examples are intended for purposes of illustration only and are not intended to limit the scope of the present disclosure.

DRAWINGS

Figure 2:
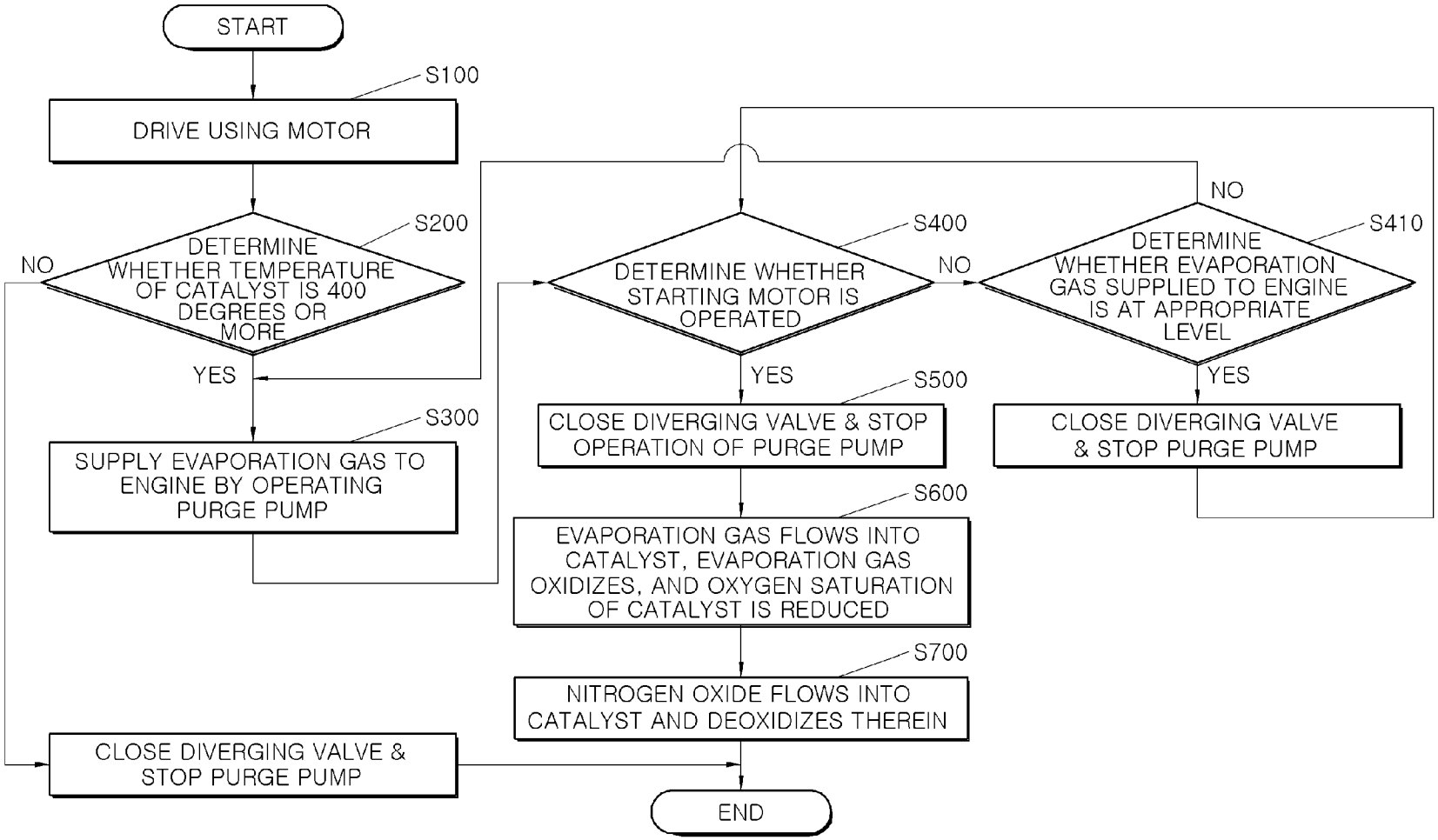

In order that the disclosure may be well understood, there will now be described various forms thereof, given by way of example, reference being made to the accompanying drawings, in which:

FIG. 1 is an exemplary view of an automobile power system according to a form of the present disclosure; and FIG. 2 is a flowchart showing a method of restarting an engine in an automobile power system in a vehicle according to a form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, an automobile power system according to a form of the present disclosure and a method of restarting an engine of an automobile power system in a vehicle will be described with reference to the accompanying drawings.

FIG. 1 shows an example of an automobile power system according to a form of the present disclosure. As shown in FIG. 1, the automobile power system according to a form of the present disclosure includes an engine 100 that supplies power to driving wheels W, a motor 200 that supplies power to the driving wheels W independently from the engine 100 and is driven even with the engine 100 stopped, an intake pipe 300 through which external air is supplied to the engine 100, a canister 400 that is connected with a fuel tank T to absorb evaporation gas produced in the fuel tank T, an active purging system 500 that compresses and supplies the evaporation gas absorbed in the canister 400 to the intake pipe 300, a diverging line 600 that extends from the active purging system 500 to the engine 100, a diverging valve 700 that is mounted on the diverging line 600, a starting motor 800 that rotates a crankshaft when the engine 100 is started, an exhaust pipe 900 through which combustion gas is discharged from the engine 100, a catalyst 910 that is mounted on the exhaust pipe 900, a turbocharger 920 mounted on the exhaust pipe 900, and a compressor 310 that is mounted on the intake pipe 300 to be synchronized in rotation with a turbocharger. According to a form of the present disclosure, the starting motor 800 is operated after the evaporation gas absorbed in the canister 400 is supplied to the engine 100 through the diverging line 600 before the engine 100 is restarted.

The active purging system 500 includes a purge line 510 that connects the canister 400 and the intake pipe 300, a purge pump 520 that is mounted on the purge line 510, a purge valve 530 that is mounted on the purge line 510 between the purge pump 520 and the intake pipe 300, a first pressure sensor 540 that is mounted on the purge line 510 between the purge pump 520 and the purge valve 530, and a second pressure sensor 550 that is mounted on the purge line 510 between the canister 400 and the purge pump 520. The canister 400 includes a vent line 410 that extends toward the atmosphere from the canister 400, a filter 420 that is mounted at an end of the vent line 410, and a vent valve 430 that is mounted on the vent line 410 between the canister 400 and the filter 420. The diverging line 600 diverges from the purge line 510 between the first pressure sensor 540 and the purge pump 520. On the other hand, the diverging line 600 may diverge from the purge line 510 between the second pressure sensor 550 and the purge pump 520.

It is possible to calculate the flow rate of evaporation gas flowing to the intake pipe 300 from the purge line 510 by controlling the RPM of the purge pump and the degree of opening of the purge valve 530.

In particular, it is possible to compress and supply evaporation gas to the intake pipe 300 by controlling the revolutions per minute (RPM) of the purge pump 520 and the degree of opening of the purge valve 530, so even if the internal pressure of the intake pipe 300 increases up to or over the atmospheric pressure due to a charger, it is possible to easily inject the evaporation gas into the intake pipe 300.

When the diverging line 600 is connected to the intake pipe 300, evaporation gas may be discharged to the atmosphere through the intake pipe 300, so the diverging line 600 is connected close to the engine 100. The diverging line 600 is a rubber hose with both ends connected to the purge line 510 and the engine 100. A T-pipe is mounted on the purge line 510. An end of the diverging line 600 is mounted on the T-pipe. The other end of the diverging line 600 is mounted on a surge tank of the engine 100. The other end of the diverging line 600 mounted on the surge tank of the engine 100 is fastened by a clamp. The other end of the diverging line 600 may be directly connected to a cylinder head or may be connected to an intake manifold of the engine 100.

The diverging valve 700 and the purge valve 530 are solenoid valves. The degree of opening in the diverging valve 700 and the purge valve 530 can be adjusted through duty control. The diverging valve 700 is controlled to be fully (100%) opened when the engine 100 is stopped, and is controlled to be fully closed when the starting motor 800 is operated. Since the fuel is supplied by a fuel supply system after the starting motor 800 is operated, the diverging valve 700 is closed to inhibit dense combustion when the engine is restarted. The purge valve 530 is fully closed when the engine 100 is stopped. As the purge valve 530 is fully closed, evaporation gas cannot flow into the intake pipe 300 when the purge pump 520 is operated.

The catalyst 910 includes a precious metal. The catalyst 910 includes any one or more of a 3-way catalyst, an oxidation catalyst, and a lean NOx traps (LNT). Depending on cases, a catalyst 910 such as a selective catalytic reduction (SCR) and a diesel particulate filter (DPF) may be additionally mounted on the exhaust pipe 900.

The automobile power system having this configuration according to a form of the present disclosure restarts the engine 100 during driving in accordance with the process shown in FIG. 2. As shown in FIG. 2, a method of restarting the engine 100 in the automobile power system in the vehicle includes steps of driving a vehicle using the motor 200 (S100), determining whether the temperature of the catalyst 910 mounted on the exhaust pipe 900 is a catalyst activation temperature or more (S200), supplying evaporation gas to the engine 100 by operating the purge pump 520 of the active purging system 500 (S300), determining whether the starting motor 800 is operated (S400), closing the diverging valve 700 mounted on the diverging line 600 connecting the active purging system 500 and the engine 100, and stopping the operation of the purge pump 520 (S500), decreasing oxygen saturation of the catalyst 910 by making the evaporation gas supplied to the engine 100 by operating of the starting motor 800 flow in the catalyst 910 and then oxidizing the evaporation gas (S600), and deoxidizing nitrogen oxides that have been produced by starting of the engine 100 and have flowed in the catalyst 910 (S700).

The catalyst activation temperature may be 400 degrees Celsius or more. When the temperature of the catalyst 910 is not the catalyst activation temperature or more, as the result of the determining of whether the temperature of the catalyst 910 is a catalyst activation temperature or more (S200), the diverging valve 700 mounted on the diverging line 600 connecting the active purging system 500 and the engine 100 is closed and the purge pump 520 keeps stopped. The determining of whether the temperature of the catalyst 910 is a catalyst activation temperature or more (S200) is performed simultaneously with generation of a signal for restarting the engine 100 during the driving of a vehicle using the motor 200 (S100).

When the temperature of the catalyst 910 is not the catalyst activation temperature or more, hydrocarbon is likely to be discharged without oxidizing even though evaporation gas flows into the catalyst 910. Due to this, according to a form of the present disclosure, movement of evaporation gas from the canister 400 to the engine 100 is inhibited by closing the diverging valve 700.

In the supplying of evaporation gas to the engine 100 (S300), the concentration of the evaporation gas in the active purging system 500 is calculated. In addition, the RPM and the operation time of the purge pump 520 is calculated on the basis of the calculated concentration of the evaporation gas, and then the purge pump 520 is operated on the basis of the calculated RPM and operation time. It is possible to calculate the concentration and pressure of evaporation gas compressed between the diverging valve 700 and the purge pump 520, and it is also possible to calculate the flow rate of the evaporation gas flowing into the engine 100 from the diverging line 600 on the basis of the degree of opening of the diverging valve 700 and the RPM of the purge pump 520. Therefore, it is possible to supply evaporation gas having specific concentration to the engine 100 at a specific flow rate.

In the determining of whether the starting motor 800 is operated (S400), when it is determined that the starting motor 800 is not operated, determining whether the evaporation gas supplied to the engine 100 is at an appropriate level is performed (S410). When the evaporation gas supplied to the engine 100 is less than the appropriate level, the supplying of evaporation gas to the engine 100 by operating the purge pump 520 (S300) is performed again. Evaporation gas is additionally supplied to increase the amount of the evaporation gas supplied to the engine 100 up to the appropriate level, thereby securing the amount of reduction of the oxygen saturation of the catalyst 910 due to oxidation in the catalyst 910.

When the evaporation gas supplied to the engine 100 is at the appropriate level or higher, the diverging valve 700 mounted on the diverging line 600 connecting the active purging system 500 and the engine 100 is closed and the purge pump 520 is stopped. Supply of evaporation gas is stopped to maintain the amount of the evaporation gas supplied to the engine 100 at the appropriate level, thereby inhibiting excessive reduction of the oxygen saturation of the catalyst 910 due to oxidation in the catalyst 910.

According to the automobile power system having the configuration according to a form of the present disclosure and the method of restarting an engine 100 in an automobile power system for a vehicle, when the starting motor 800 is operated, the evaporation gas that is injected into the engine 100 or exists in the diverging line 600 is moved to the exhaust pipe 900 by piston pumping. The evaporation gas is oxidized by the catalyst 910 mounted on the exhaust pipe 900 and having a temperature over a catalyst activation temperature, whereby hydrocarbon contained in the evaporation gas is reduced. As the evaporation gas is oxidized, the oxygen concentration of the catalyst 910 is reduced. The atmosphere of the catalyst 910 becomes dense, so it becomes favorable to deoxidization of nitrogen oxides.

While the present disclosure has been described in connection with what is presently considered to be practical exemplary forms, it is to be understood that the present disclosure is not limited to the disclosed forms, but, on the contrary, it is intended to cover various modifications and equivalent arrangements included within the spirit and scope of the present disclosure.

What is claimed is:

1. An automobile power system comprising:

an intake pipe supplying external air to an engine supplying power to driving wheels;

a canister connected with a fuel tank to absorb evaporation gas produced in the fuel tank;

an active purging system compressing and supplying the evaporation gas absorbed in the canister to the intake pipe;

a diverging line extending from the active purging system to the engine;

a diverging valve mounted on the diverging line; and a starting motor rotating a crankshaft when the engine is started, wherein the evaporation gas absorbed in the canister is supplied to the engine through the diverging line before the engine is restarted, and then the starting motor is operated.

2. The automobile power system of claim 1, wherein the active purging system includes:

a purge line connecting the canister and the intake pipe;

a purge pump mounted on the purge line;

a purge valve mounted on the purge line between the purge pump and the intake pipe;

a first pressure sensor mounted on the purge line between the purge pump and the purge valve; and a second pressure sensor mounted on the purge line between the canister and the purge pump, wherein the diverging line diverges from the purge line between the first pressure sensor and the purge pump, or from the purge line between the second pressure sensor and the purge pump.

3. The automobile power system of claim 1, further comprising an exhaust pipe through which combustion gas from the engine is discharged, wherein the exhaust pipe includes:

a catalyst mounted on the exhaust pipe;

a turbocharger mounted on the exhaust pipe; and a compressor mounted on the intake pipe to be synchronized in rotation with the turbocharger, and the canister includes:

a vent line extending toward atmosphere from the canister;

a filter mounted at an end of the vent line; and a vent valve mounted on the vent line between the canister and the filter.

4. The automobile power system of claim 3, the catalyst includes precious metal.

5. The automobile power system of claim 1, wherein the diverging valve is fully opened when the engine is stopped, and is fully closed when the starting motor is operated.

6. The automobile power system of claim 5, wherein a purge valve provided in the active purging system to connect/disconnect the canister and the intake pipe is fully closed when the engine is stopped.

7. The automobile power system of claim 5, further comprising:

a motor supplying power to the driving wheels independently from the engine and being driven even with the engine stopped.

8. The automobile power system of claim 7, wherein the diverging valve is fully opened when the engine is stopped, and is fully closed when the starting motor is operated.

9. The automobile power system of claim 8, wherein a purge valve provided in the active purging system to connect/disconnect the canister and the intake pipe is fully closed when the engine is stopped.

10. A method of restarting an engine in an automobile power system for a vehicle, the method comprising steps of:

driving the vehicle with the engine stopped;

determining whether temperature of a catalyst mounted on an exhaust pipe is a catalyst activation temperature or more;

supplying evaporation gas to the engine by operating a purge pump of an active purging system;

determining whether a starting motor is operated; and closing a diverging valve mounted on a diverging line connecting the active purging system and the engine, and stopping operation of the purge pump.

11. The method of claim 10, further comprising steps of:

decreasing oxygen saturation of the catalyst by making evaporation gas supplied to the engine by operating of the starting motor flow in the catalyst and then oxidizing the evaporation gas; and deoxidizing nitrogen oxides that have been produced by starting of the engine and have flowed in the catalyst.

12. The method of claim 10, wherein when the temperature of the catalyst is not the catalyst activation temperature or more, the diverging valve is closed and the purge pump is stopped.

13. The method of claim 10, wherein in the supplying of evaporation gas to the engine, concentration of the evaporation gas in the active purging system is calculated, RPM and operation time of the purge pump is calculated on the basis of the calculated concentration of the evaporation gas, and then the purge pump is operated on the basis of the calculated revolutions per minute (RPM) and operation time.

14. The method of claim 10, wherein when the starting motor is not operated, determining whether the evaporation gas supplied to the engine is at an appropriate level is performed, when the evaporation gas supplied to the engine is less than the appropriate level, the supplying of evaporation gas to the engine by operating the purge pump is performed again, and when the evaporation gas supplied to the engine is at the appropriate level or higher, the diverging valve is closed and the purge pump is stopped.

15. A method of restarting an engine in an automobile power system for a vehicle, the method comprising steps of:

driving the vehicle using a motor;

determining whether temperature of a catalyst mounted on an exhaust pipe is a catalyst activation temperature or more;

supplying evaporation gas to the engine by operating a purge pump of an active purging system;

determining whether a starting motor is operated;

closing a diverging valve mounted on a diverging line connecting the active purging system and the engine; and stopping operation of the purge pump.

16. The method of claim 15, wherein in the supplying of evaporation gas to the engine, concentration of the evaporation gas in the active purging system is calculated, revolutions per minute (RPM) and operation time of the purge pump is calculated on the basis of the calculated concentration of the evaporation gas, and then the purge pump is operated on the basis of the calculated RPM and operation time.

17. The method of claim 15, wherein when the starting motor is not operated, determining whether the evaporation gas supplied to the engine is at an appropriate level is performed, when the evaporation gas supplied to the engine is less than the appropriate level, the supplying of evaporation gas to the engine by operating the purge pump is performed again, and when the evaporation gas supplied to the engine is at the appropriate level or higher, the diverging valve is closed and the purge pump is stopped.

* * * * *